US008196788B1

(12) United States Patent
Demko et al.

(10) Patent No.: US 8,196,788 B1
(45) Date of Patent: Jun. 12, 2012

(54) IMPLEMENT SCABBARD

(75) Inventors: Andrew Demko, Wampum, PA (US); Michael Travis Wallace, New Castle, PA (US)

(73) Assignee: Cold Steel, Ventura, CA (US)

( * ) Notice: Subject to any disclaimer, the term of this patent is extended or adjusted under 35 U.S.C. 154(b) by 52 days.

(21) Appl. No.: 12/800,918

(22) Filed: May 26, 2010

(51) Int. Cl.
*A45F 5/14* (2006.01)

(52) U.S. Cl. ..... 224/234; 224/232; 224/242

(58) Field of Classification Search ..... 224/232–234, 224/237, 250, 272, 242, 247, 197, 674, 676, 224/678, 682, 684, 191; 30/298.4, 308.1, 30/308.2; 206/349; 7/116; D3/220
See application file for complete search history.

(56) References Cited

U.S. PATENT DOCUMENTS

| | | | | |
|---|---|---|---|---|
| 1,215,251 | A * | 2/1917 | Clauser | 224/603 |
| 1,342,395 | A | 6/1920 | Rosenquist | |
| 1,633,319 | A * | 6/1927 | Estwing | 224/234 |
| 1,821,258 | A | 9/1931 | Clark | |
| 1,928,063 | A | 9/1933 | Lehmann | |
| 3,130,883 | A * | 4/1964 | MacKool | 224/232 |
| 3,404,412 | A * | 10/1968 | Ryan | 7/116 |
| D253,798 | S | 1/1980 | Altmiller | |
| 4,909,424 | A | 3/1990 | Reynolds | |
| 5,820,001 | A | 10/1998 | Soros | |
| D530,906 | S | 10/2006 | Polak et al. | |

* cited by examiner

*Primary Examiner* — Justin Larson
*Assistant Examiner* — Corey Skurdal
(74) *Attorney, Agent, or Firm* — Harpman & Harpman

(57) ABSTRACT

A scabbard for axes or tomahawks that provides a lightweight and foldable integrated head cover configuration that encloses the respective sharpened surfaces of the weapon in multiple pivoted hard case covers for safety and transport on the person of the user.

2 Claims, 4 Drawing Sheets

IMPLEMENT SCABBARD

BACKGROUND OF THE INVENTION

1. Technical Field

This invention relates to scabbards and covers that are used to cover and hold hatchets, axes, and other types of handheld tools that have a short handle with a fixed head and sharpened blade-like surfaces. Such scabbards allow a user to safely carry and transport the weapons on their person.

2. Description of Prior Art

Prior art devices of this type have heretofore been directed towards flexible and fixed covers into which the axe head or hatchet head is slidably positioned and held by folding interengageable flaps and retaining straps. See for example U.S. Pat. Nos. 1,342,395, 1,821,258, 1,928,063, 4,909,424, and 5,820,001, and Design Pats. D530,906 and D253,798.

In U.S. Pat. No. 1,342,395 an axe sheath is disclosed having a handle portion into which a non-bladed end of the axe is first positioned and a pivot blade sheath extends therefrom for receiving the axe head.

U.S. Pat. No. 1,821,258 shows another axe scabbard with a contoured handle and blade engagement surface having blade cover flaps fold over and multiple depending retainment straps on each side of the handle.

U.S. Pat. No. 1,928,063 illustrates a holder for headed tools having a leather T-shaped frame with a blade hatchet and retainment straps.

U.S. Pat. No. 4,909,424 shows a knife sheath with a blade-enclosed pocket pivoted to the handle.

In U.S. Pat. No. 5,820,001 a hatchet scabbard is disclosed having flexible formed blade pocket and integrated retainment straps.

Design Pats. 253,793 and 530,906 both show fixed rigid hatchet head holders in which the blade portion is received and held by associated integrated overlapping straps.

SUMMARY OF THE INVENTION

A compact pivoted hard shell implement scabbard for tomahawk type weapons that have sharpened axe-like blades and points attached to a short handle. The scabbard has multiple opposing blade receiving enclosures pivotally secured to one another by a connection bracket that allows simple and quick placement on and retainment over the tomahawk end surfaces with a single retainment strap.

DETAILED DESCRIPTION OF THE INVENTION

Figure 1:
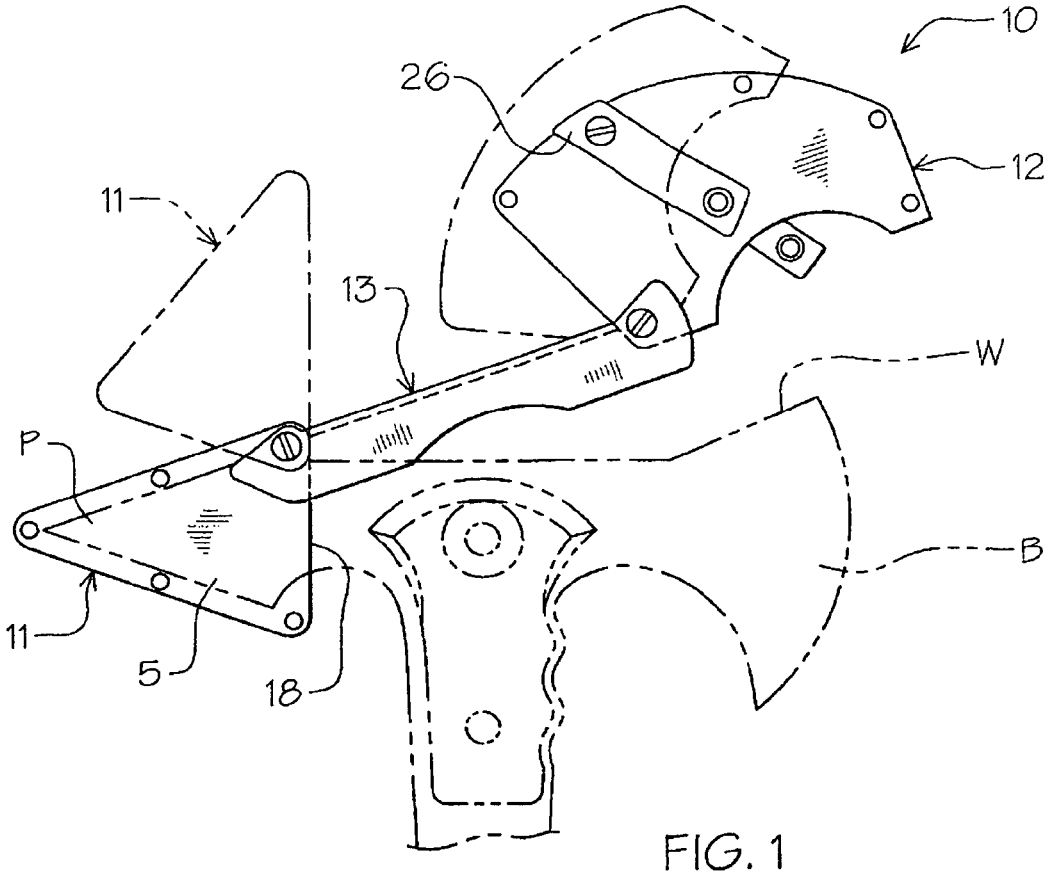
FIG. 1 is a side elevational view of the scabbard positioned partially on a tomahawk weapon shown in broken lines.
Figure 2:
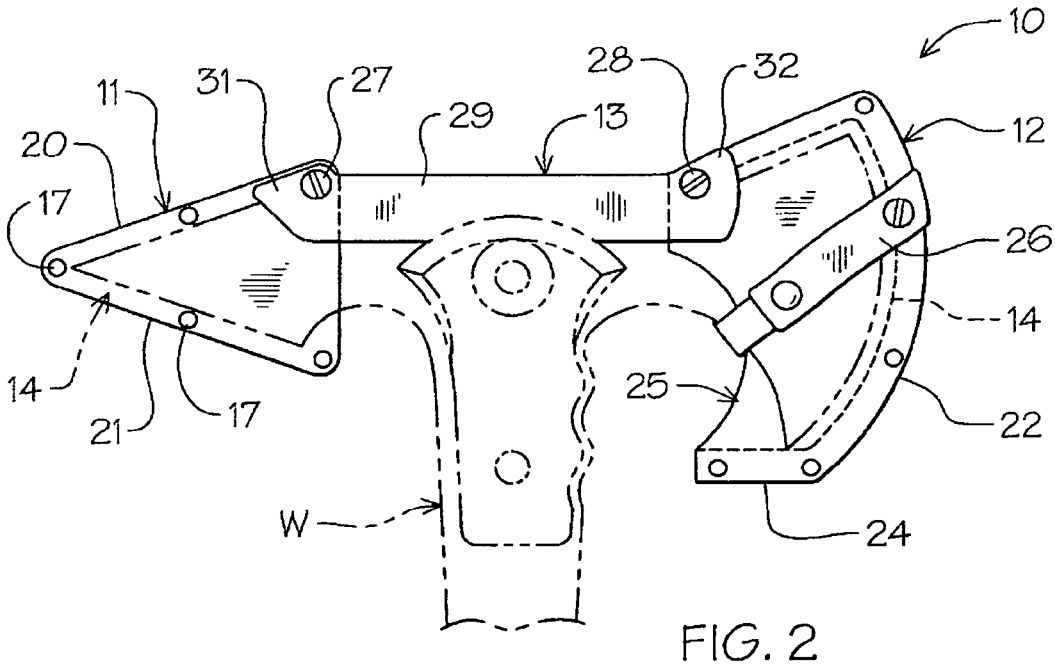
FIG. 2 is a side elevational view with the scabbard completely positioned on the tomahawk weapon.

Referring to FIGS. 1, and 2 of the drawings, a weapon scabbard 10 for tomahawk weapons W can be seen having a first blade cover portion 11 and a second blade cover portion 12 pivotally secured to an intermediate elongated connector bracket 13.

The first and second blade covers 11 and 12 are of a similar construction method formation defining a pair of blade-shaped specific retainment pocket covers. Each of the blade covers 11 and 12 have identical front and back surface panels P secured to one another in space parallel relation by an edge band insert fitting 14 formed by a pair of identical band plate elements 15 and 16 of a co-contoured configuration as to the respective first and second blade covers extending inwardly from their respective panels perimeter edges partially thereabout.

Multiple assembly facet rivets 17 extend through and secure the panels P and interposition inserted edge band fitting 14 to one another.

Figure 3:
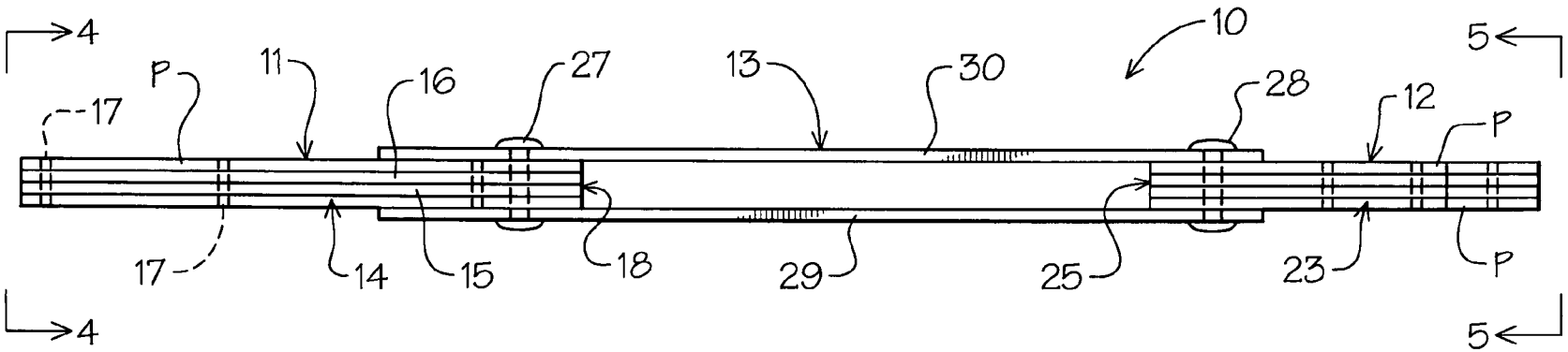
FIG. 3 is top plan view of the scabbard of the invention.

The first band cover portion 11 is of a generally triangular configuration with a blade-receiving slot opening 18 therein defined by the panels P between corresponding edge band insert fitting 14 enclosed edge surfaces 20 and 21 as best seen in FIGS. 1 and 3 of the drawings.

The second blade cover portion 12 has a closed curved edge band surface 22 with an angularly disposed closed top and bottom edge bands 23 and 24 defining a corresponding blade-receiving slot opening 25 there between. The blade-receiving slot opening 25 has a mid-termed curved recess area in the respective panels P to accommodate the corresponding blade B of a weapon W, shown in broken lines, inserted and additionally retained therein by a strap and snap fitting 26 extending transversely there across as seen best in FIG. 2 of the drawings.

Referring now to FIGS. 3-6 of the drawings, the elongated connector bracket 13 can be seen pivotally secured to the first and second blade covers 11 and 12 adjacent to their respective blade-receiving slot openings 18 and 25 by respective pivot pins 27 and 28. The connector bracket 13 has identical shaped front and rear elongated elements 29 and 30 each having aperture contoured enlarged opposing ends 31 and 32 which as noted are pivotally secured to the respective exterior panel P surfaces S of each of the blade-receiving covers 11 and 12.

It will be seen that the corresponding axial points of the pivot pin attachment of the connector bracket 13 to the blade covers 11 and 12 being adjacent their respective slot openings 18 and 25 allow for multiple angular articulation of the blade covers 11 and 12 independently as connected to the is bracket 13 illustrated in FIG. 1 of the drawings in broken and solid lines.

The independent pivoting positions of the blade covers 11 and 12 with respect to the connector bracket 13 provides for quick and easy placement of the scabbard 10 of the invention over the blade portions of the weapon W for safer user carrying on their person. Additionally, the folding ability of the safety weapons scabbard 10 of the invention when not in use increases the propensity of user use compliance given that it can be placed in a pocket when not in use but be easily accessible, not shown.

Figure 5:
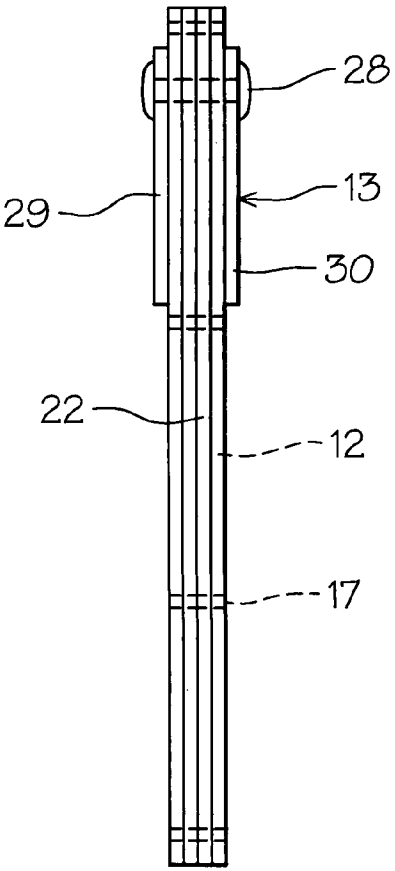
FIG. 5 is an end view on lines 5-5 of FIG. 3.
Figure 4:
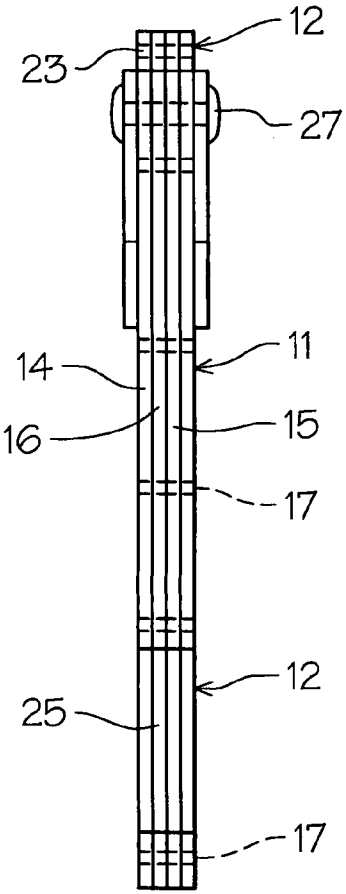
FIG. 4 is an end view on lines 4-4 of FIG. 3.
Figure 6:
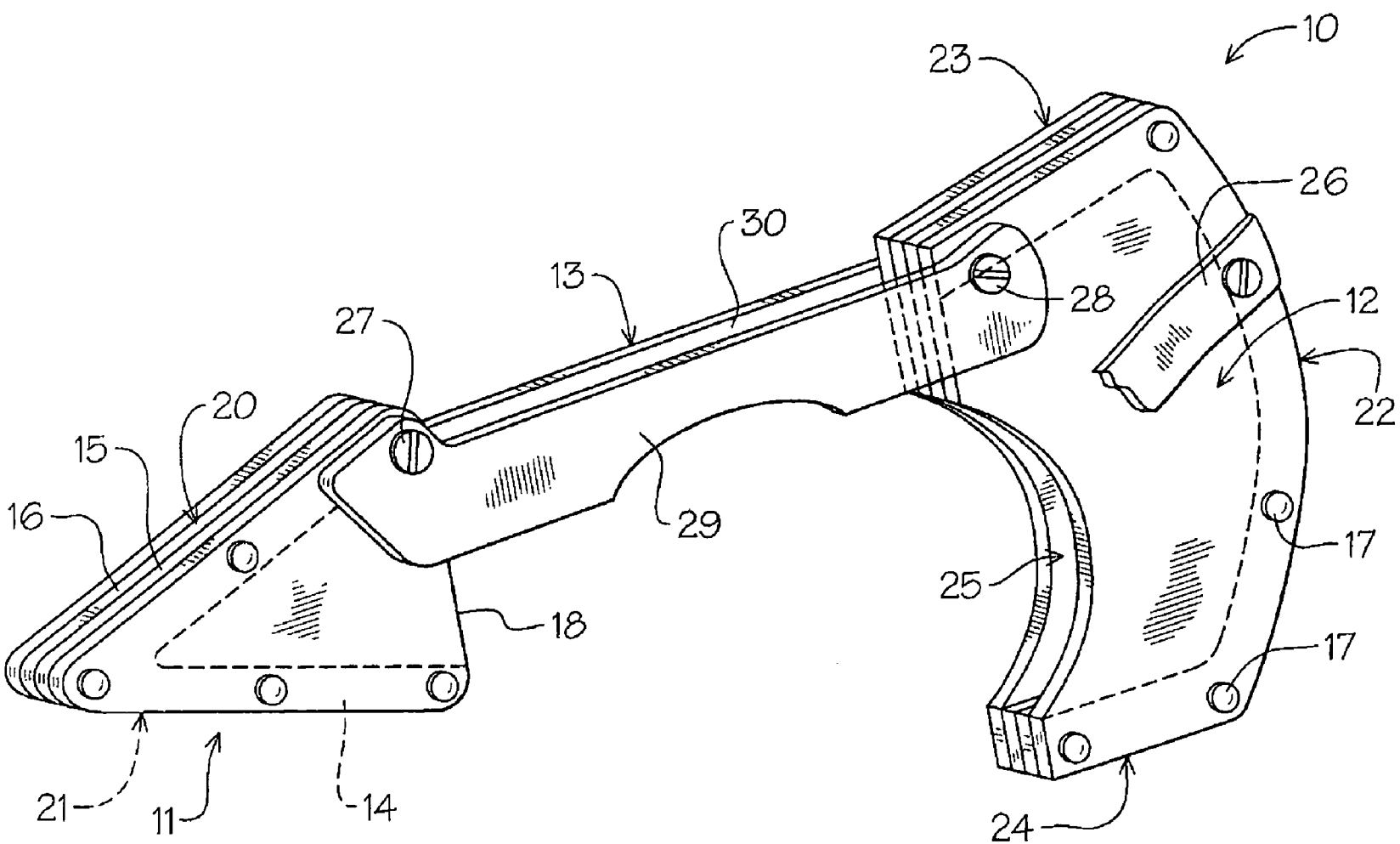
FIG. 6 is a perspective view of the tomahawk scabbard.

Referring now to FIGS. 4 and 5 of the drawings, the respective end views of the rigid retainment blade covers 11 and 12 can be seen illustrating the pivot attachment point of the pivot pins 27 and 28 through the aperture enlarged ends 31 and 32 of the connector bracket 13 and the respective closed end edge surfaces 20 and 21 on the cover 11 and closed end curved edge surface 22 comprised of the continued edge band insert fitting 14 designed by the abutting band contoured plates 15 and 16 secured together by fastener rivets 17 to the respective surface panels Pas hereinbefore described.

It will be evident from the above description that by utilization of the dual hard surface blade cover portions 11 and 12 interconnected and in spaced oppositely disposed relation by respective pivot pins through corresponding aperture ends of the bifurcated connection bracket 13 that the scabbard of the invention will be in compliance for easy deployment and insertion on to the ends of a tomahawk-like weapon W configuration illustrated in broken lines in FIGS. 1 and 2 of the drawings affording a safe simple and durable safety cover configuration for the user's benefit It will thus be seen that a new and novel folding weapon scabbard 10 has been illustrated and described and various changes and modifications may be made therein without departing from the spirit of the invention.

We claim:

1. A folding rigid weapon scabbard for a tomahawk having a handle and a fixed pair of oppositely disposed blades thereon, said scabbard comprising, a first and second blade-receiving cover pockets, said first and second blade cover pockets pivotally secured to oppositely disposed ends of an interconnector bracket in spaced effaced relation to one another, said first and second blade cover pockets each comprising of oppositely opposed laterally spaced side panels, a perimeter edge spacer band assembly secured between said side panels defining a blade-receiving engagement slot, in communication therewith, wherein said interconnector bracket is bifurcated for pivotal registration on oppositely disposed exterior surfaces of said side panels of said respective first and second blade cover pockets, and a retaining strap on said second blade cover pocket extending therefrom selectively secured over a portion of one of said blades positioned therewithin.

2. The folding rigid weapon scabbard for a tomahawk set forth in claim 1 wherein said first and second blade receiving cover pockets for receiving said spaced opposing fixed blades of said tomahawk are adjacent said pivot points of pivotal attachment to said interconnection bracket.

* * * * *